United States Patent [19]

Kauffman

[11] Patent Number: 4,627,611

[45] Date of Patent: Dec. 9, 1986

[54] IMPACT TRAINING DEVICE

[76] Inventor: Stephen R. Kauffman, 2650 N. Miracle Mile, Apartment 819, Tucson, Ariz. 85705

[21] Appl. No.: 649,728

[22] Filed: Sep. 12, 1984

[51] Int. Cl.[4] ..... A63B 69/00

[52] U.S. Cl. ..... 272/77

[58] Field of Search ..... 272/76, 77, 78; 273/55 A; 135/119

[56] References Cited

U.S. PATENT DOCUMENTS

| | | | |
|---|---|---|---|
| 124,588 | 3/1872 | Kehoe | 272/77 |
| 647,487 | 4/1900 | Frazier | 272/78 |
| 689,344 | 12/1901 | Yoerger et al. | 272/78 |
| 755,689 | 3/1904 | McFadden | 272/78 |
| 788,245 | 4/1905 | Burtt | 272/77 |
| 822,789 | 6/1906 | Twiss | 272/77 |
| 2,931,133 | 4/1960 | Dodson | 272/78 |
| 3,103,083 | 9/1963 | Seeger | 135/119 |

*Primary Examiner*—Richard J. Apley
*Assistant Examiner*—S. R. Crow
*Attorney, Agent, or Firm*—Lackenbach Siegel Marzullo & Aronson

[57] ABSTRACT

An impact training device comprising a relatively small punching or kicking bag that is adjustably connected at its upper end to a generally circular board member by a flexible and resilient cord member. The position of the cord member on the board member is adjustable so as to vary the distance between the bag and the bottom of the board member. Connected to and extending upwardly from the board member are a plurality of flexible mounting cords secured to a generally conical or cylindrical, flexible net member having its bottom end surrounding and secured to the board member. Suitable mounting members are secured to the upper ends of the mounting cords for connecting them to a suitable support such as a ceiling or the like.

13 Claims, 4 Drawing Figures

FIG. 1
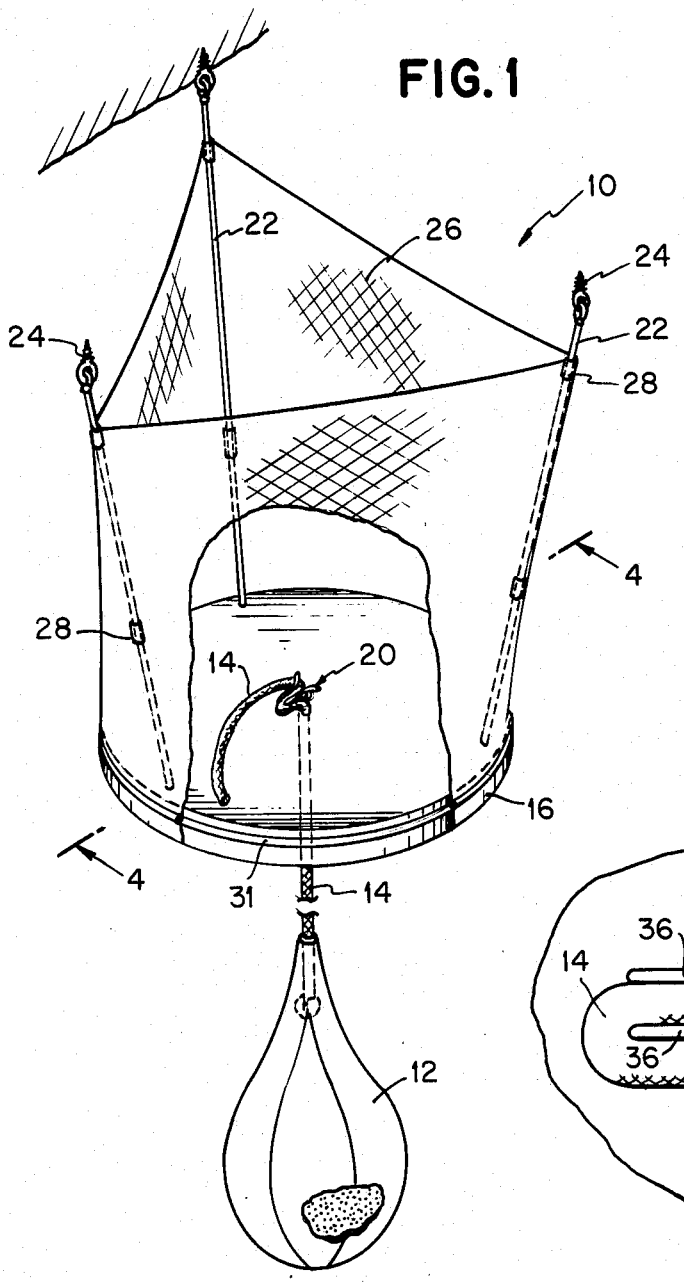
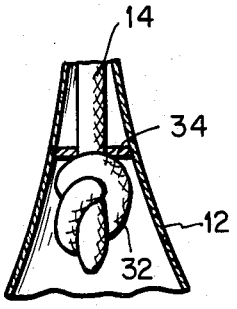
FIG. 2
FIG. 3
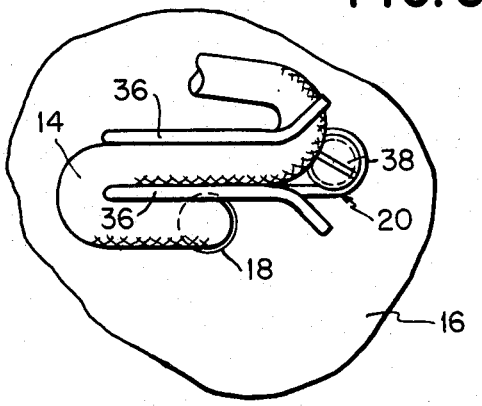
FIG. 4
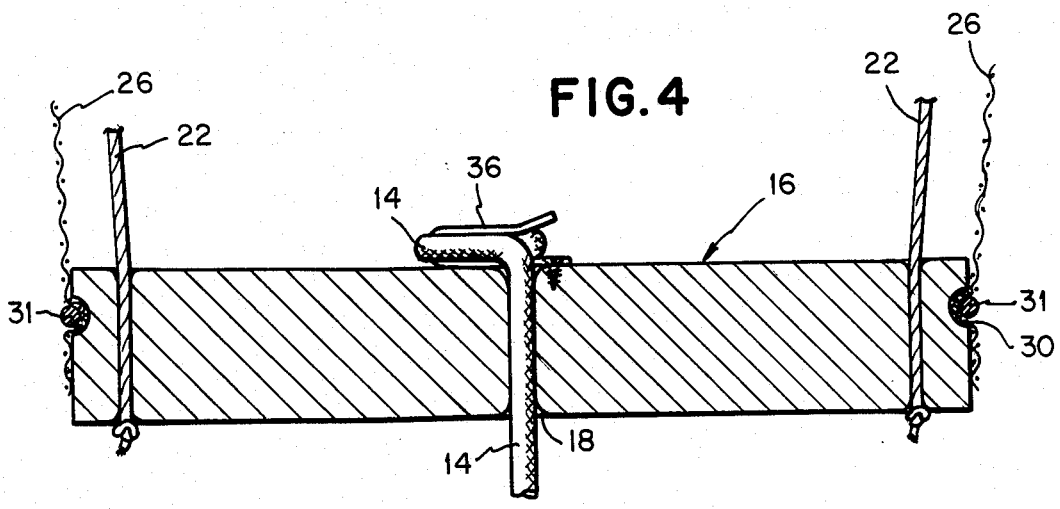

IMPACT TRAINING DEVICE

BACKGROUND OF THE INVENTION

The present invention relates to an impact training device and, more particularly, to such a device that is lightweight and adjustable such that it can be conveniently used in the home to practice all forms of fighting sports, such as boxing or the martial arts.

Up to the present time, there has not been available a lightweight and adjustable training device for practicing fighting sports, such as boxing or the martial arts, other than the typical punching bags. In most cases, such punching bags have not been suitable for home use because of their heavy construction which makes them difficult to handle and install, and because of the noise and vibrations caused by such punching bags when used. Also, typical punching bags have not been constructed to be used both for boxing practice and the practice of martial arts, such as karate kicks or the like. Another disadvantage of the previously and presently used punching bags is that they are not constructed to simulate the motion of an actual opponent under sparring conditions.

Accordingly, a need has arisen for a simple, lightweight and adjustable impact training device which can be used to practice all forms of fighting sports, such as boxing and the martial arts, and which simulates the motion of an actual opponent under sparring conditions. The impact training device of the present invention fulfills this need.

SUMMARY OF THE INVENTION

The impact training device of the present invention comprises a relatively small punching or kicking bag that is adjustably connected at its upper end to a generally circular board member or the like by a flexible and resilient cord member, such as a "bunji" cord. The position of the cord member on the board member can be easily adjusted manually so as to vary the distance between the punching or kicking bag and the bottom of the board member.

Connected to and extending upwardly from the board member are a plurality of flexible mounting cords having secured thereto a generally conical or cylindrical, flexible net member having its bottom end surrounding and secured to the board member within a circumferential groove therein. Suitable mounting members such as screw eyes may be used for securing the upper ends of the mounting cords to an overhead mount such as a ceiling or the like.

Because of the adjustable mounting of the punching or kicking bag, the flexible and resilient cord member connecting the bag to the board member, and the flexible mounting cords and surrounding net member, the impact training device of the present invention can be conveniently installed in the home, used for practicing any form of fighting sport, such as boxing or the martial arts, is silent in operation, and simulates the motion of an actual opponent under sparring conditions.

BRIEF DESCRIPTION OF THE DRAWING

FIG. 1 is a perspective view of an impact training device constructed in accordance with the principles of the present invention;

FIG. 2 is an enlarged side elevational view in section, with parts broken away, of a portion of the bag of the impact training device shown in FIG. 1;

FIG. 3 is an enlarged plan view of a portion of the board member for the impact training device of the present invention, showing the locking member for releasably retaining the bag supporting member thereon in a desired position; and FIG. 4 is an enlarged sectional view taken substantially along line 4—4 in FIG. 1.

DESCRIPTION OF THE PREFERRED EMBODIMENT

As shown in FIGS. 1–4, the impact training device 10 of the present invention generally comprises a bag 12, a flexible and resilient cord member 14 having its lower end connected to the bag 12 and its upper end connected to the upper surface of a board member 16. The cord member 14 extends through a central aperture 18 in the board member 16 and can be releasably retained within a locking or hook member 20 mounted on the upper surface of the board member 16 adjacent the aperture 18 therethrough.

A plurality of flexible mounting cords 22 are connected at their lower ends to the board member 16 and at their upper ends to securing means such as screw eyes 24 or the like that are adapted to be secured to an overhead mounting such as a ceiling or the like. A generally flexible, conical or cylindrical net member 26 is connected to the mounting cords 22 by any suitable means such as clamps 28. The lower end of the net member 26 surrounds the upper circumferential portion of the board member 16 and is secured in a circumferential groove 30 therein by any suitable means such as a spline 31.

The bag 12 may be of any suitable or desired construction. Preferably, it is a leather bag with an inner soft lining formed of wool or the like and is filled with sand or another suitable material such that it weighs approximately two pounds. The bag 12 may be of any suitable or desired size, such as approximately four to five inches in width and six to eight inches in height.

As shown in FIG. 2, the lower end of the cord member 14 extends through an opening in the upper end of the bag 12 and is retained therein by a knot 32 in the cord member and a washer 34 mounted on the cord member above the knot 32. Within the scope of the present invention, the lower end of the cord member 14 may be secured to the bag 12 in any other suitable manner.

The cord member 14 may be formed of any suitable flexible and resilient material, such as rubber, plastic or the like, and preferably is about three feet in length. The position of the cord member 14 on the board member 16 can be easily adjusted to adjust to the height of the bag 12 by moving the cord member 14 through the central aperture 18 in the board member 16 and then removably locking the cord member 14 between the hook arms 36 of the locking member 20 secured to the upper surface of the board member 16 by any suitable means such as a screw 38. It is noted that any suitable means other than the locking member 20 may be used to releasably lock the cord member 14 in a desired position on the board member 16.

The board member 16 may be of any suitable shape and construction. Prepferably, the board member is circular in shape and formed of a suitable material such as of wood. As shown in FIG. 4, the lower edges of the board member preferably are rounded or beveled to minimize wear of the cord member 14 when it engages the edge portions of the board member. Similarly, the upper and lower surfaces of the board member surrounding the central aperture 18 therein are beveled to minimize wear of the cord member 14 extending therethrough. As an illustrative example, the board member 16 may be approximately twelve inches in diameter and approximately two inches in thickness.

The mounting cords 22 and net member 26 may be of any suitable construction and, preferably, are formed of nylon or the like and are approximately three feet in length. The net member 26 may be formed with or without openings therethrough. Any suitable means, other than the screw eyes 24, may be used for securing the upper ends of the mounting cords 22 to an overhead support, such as a ceiling or the like.

In the use of the impact training device 10 of the present invention, the vertical position of the bag 12 may be readily adjusted by adjusting the position of the cord member 14 relative to the board member 16 and the locking member 20 mounted thereon. Because of the adjustability of the bag position, the training device 10 may be used for boxing, kickboxing or martial arts such as karate.

When the bag 12 is struck with a hand, foot or other body portion, it is driven upwardly into engagement with the net member 26 which, along with the flexible and resilient cord member 14, absorbs most of the shock of impact. It will be readily seen, therefore, that the training device 10 is quiet in operation and minimizes the shock of impact on the ceiling or other support on which it is mounted. Accordingly, the training device of the present invention is especially suited for home use. Because of the lightweight and simple construction of the training device 10, it may be easily installed on a ceiling or other support in a home.

The flexible and resilient cord member 14 and the net member 26 will cause the bag 12 to return in an arc-like path towards its original position in a manner that closely simulates the motion of an actual opponent under sparring conditions. The training device 10 of the present invention. therefore, is very effective in training the user in all forms of fighting sports, such as boxing or the martial arts.

I claim:

1. An impact training device, comprising:

a bag commensurate in size with the human hand and foot, a flexible and resilient cord member connected at its lower end to said bag, a board member approximately twice the size of the bag, said cord member having an upper end portion adjustably connected to said board member to vary the position of said bag relative to said board member, a flexible net member having a lower end portion surrounding and connected to said board member, said net member extending upwardly from said board member a sufficient distance to be engaged by said bag when it is struck and moves upwardly, and said net member having a mounting means secured to said board member for connecting it to a support; whereby said cord member is lengthwise adjustable to vary the distance between said bag and said board member or said net member.

2. The training device of claim 1 wherein said bag is formed of leather and is filled with a granular material.

3. The training device of claim 1 wherein said bag is filled with a granular material.

4. The training device of claim 1 wherein said bag has an opening in the upper portion thereof, and said cord member has a knot and washer on the lower end thereof that are positioned in said bag opening to connect said bag to said cord member.

5. The training device of claim 1 wherein said board member is generally circular in shape and is disposed in a generally laterally extending position.

6. The training device of claim 5 wherein said board member has an aperture therethrough and locking means mounted on the upper surface thereof, said cord member extending through said aperture and being releasably engaged by said locking means.

7. The training device of claim 6 wherein said locking means comprises a pair of hook arms adapted to frictionally engage said cord member.

8. The training device of claim 1 wherein said net member is generally cylindrical in shape.

9. The training device of claim 1 wherein said net member is generally conical in shape.

10. The training device of claim 5 wherein said board member has a circumferential groove therein, and the lower end portion of said net member is disposed in said groove.

11. The training device of claim 1 wherein said mounting means comprises a plurality of flexible cords connected at their lower ends to said board member and extending upwardly therefrom.

12. The training device of claim 11 further comprising securing means connected to the upper ends of said cords for securing them to a support.

13. The training device of claim 11 further comprising means for connecting said cords to said net member.

* * * * *